US011905828B1

(12) United States Patent
Chen et al.

(10) Patent No.: US 11,905,828 B1
(45) Date of Patent: Feb. 20, 2024

(54) MONITORING DRILLING CONDITIONS AND ESTIMATING ROCK PROPERTIES

(71) Applicant: Halliburton Energy Services, Inc., Houston, TX (US)

(72) Inventors: Shilin Chen, Conroe, TX (US); Van Jordan Brackin, Conroe, TX (US); Jonathan Kollar, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/875,107

(22) Filed: Jul. 27, 2022

(51) Int. Cl.

| | |
|---|---|
| ***E21B 49/00*** | (2006.01) |
| ***E21B 21/08*** | (2006.01) |
| ***E21B 47/04*** | (2012.01) |
| *E21B 47/013* | (2012.01) |

(52) U.S. Cl.
CPC ..... *E21B 49/003* (2013.01); *E21B 21/08* (2013.01); *E21B 47/04* (2013.01); *E21B 47/013* (2020.05)

(58) Field of Classification Search
CPC ..... E21B 49/00; E21B 49/003; E21B 47/013
See application file for complete search history.

(56) References Cited

U.S. PATENT DOCUMENTS

| | | | | |
|---|---|---|---|---|
| 5,216,917 | A * | 6/1993 | Detournay | E21B 12/02 73/152.59 |
| 5,670,711 | A | 9/1997 | Detournay et al. | |
| 2014/0153368 | A1* | 6/2014 | Bar-Cohen | G10K 11/34 367/137 |

OTHER PUBLICATIONS

E. Detournay; P. Defourny (1992). A phenomenological model for the drilling action of drag bits. , 29(1), 13-23.
Thomas Richard; Fabrice Dagrain; Edmond Poyol; Emmanuel Detournay (2012). Rock strength determination from scratch tests., 147-148(none), -.

* cited by examiner

*Primary Examiner* — Kristyn A Hall
(74) *Attorney, Agent, or Firm* — Michael Jenney; C. Tumey Law Group PLLC

(57) ABSTRACT

A method and a system for a confined compressive strength (CCS) and an unconfined compressive strength (UCS) for one or more bedding layers. The method may include identifying a depth interval during a drilling operation as a distance between a first depth and a second depth, measuring one or more drill bit responses within the depth interval using a sensor package disposed on the drill bit, identifying one or more torsional bit vibrations, and identifying one or more bedding layers of the formation within the depth interval from the one or more torsional bit vibrations. The method may further include identifying the (CCS) and the (UCS) for each of the one or more bedding layers and identifying a bit wear of the drill bit within each of the one or more bedding layers using the one or more drill bit responses and the one or more torsional bit vibrations.

22 Claims, 13 Drawing Sheets

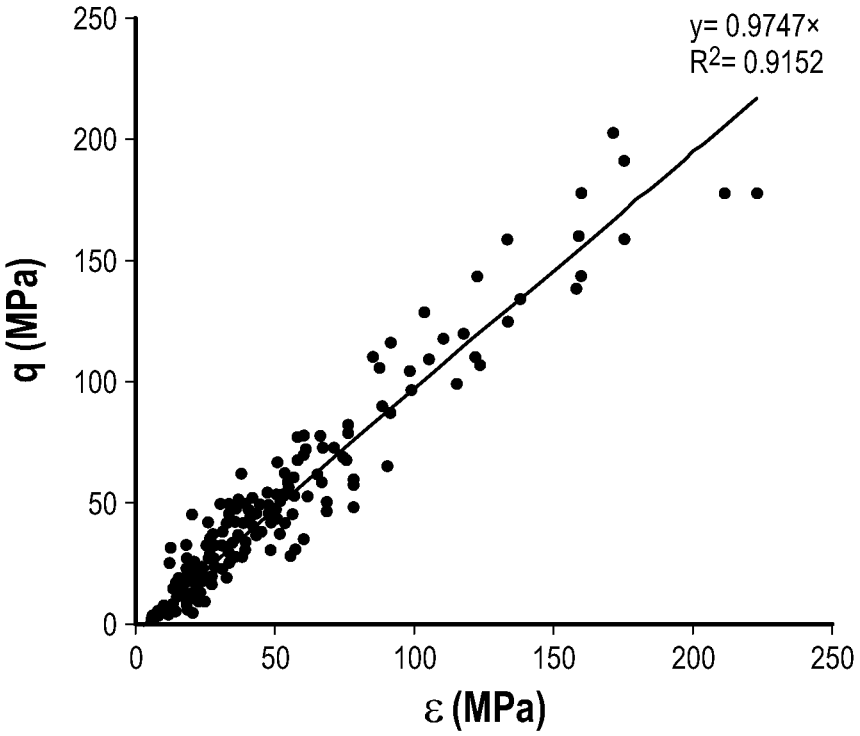
FIG. 10
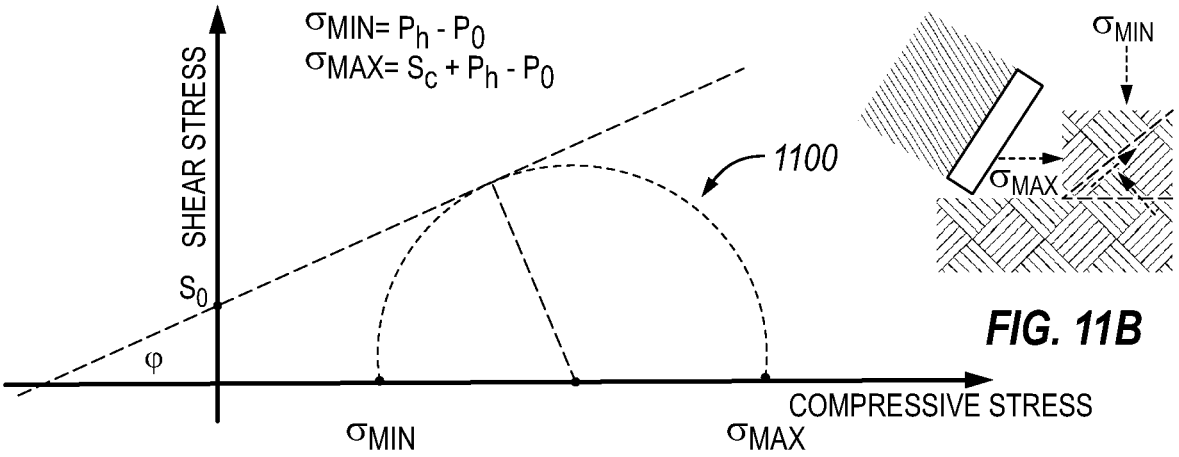
FIG. 11B
FIG. 11A

MONITORING DRILLING CONDITIONS AND ESTIMATING ROCK PROPERTIES

BACKGROUND

Wells may be drilled into subterranean formations to recover natural deposits of hydrocarbons and other desirable materials trapped in geological formations in the Earth's crust.

Wells may be drilled by rotating a drill bit which may be located on a bottom hole assembly at a distal end of a drill string in a drilling operation.

Unconfined compressive strength (UCS) is one of the most commonly required rock mechanical properties in geomechanical assessments and in drilling and completion operations. However, reliable quantitative data on UCS may only be derived at specific depths from laboratory tests on core samples, typically through destructive tests or non-destructive tests under specified conditions. It is very hard to get UCS with high resolution as a continuous function along well depth. Additionally, it is hard to make a decision to pull out a bit when rate of penetration (ROP) is reduced in drilling because it is usually unclear if the reduction of ROP is due to bit wear or due to strong formation or due to both.

BRIEF DESCRIPTION OF THE DRAWINGS

These drawings illustrate certain aspects of some examples of the present disclosure and should not be used to limit or define the disclosure.

FIG. 10 is a graph showing a correlation between intrinsic specific energy and uniaxial compressive strength;

FIG. 11A illustrates a Mohr circle;

FIG. 11B illustrates angles of the cutter on virgin pores;

DETAILED DESCRIPTION

This disclosure may generally relate to methods for determining wear to a drill bit during drilling operations and if a reduction in rate of penetration (ROP) is due to bit wear or the formation. During drilling operation, a sensor package may measure revolutions per minute of the drill bit, weight on bit, and torque on bit and send these measurements to the surface in real time. In real time is defined as every second or every few seconds. Combining rate of penetration measurements at the surface with measurements taken by the sensor package downhole different types of torsional vibration may be identified. Additionally, the measurements may be divided into sections using the torsional vibration. Within each section, unconfined compressive strength (UCS), rock internal friction angle, bit wear, or cutter damage statues may be identified. Additionally, a bit-rock interaction model may be used to estimate the error ranges of the UCS at each bit wear statues. Friction energy as a function of drilling depth may also be utilized to determine a bit wear at depth during drilling operations.

Figure 1:
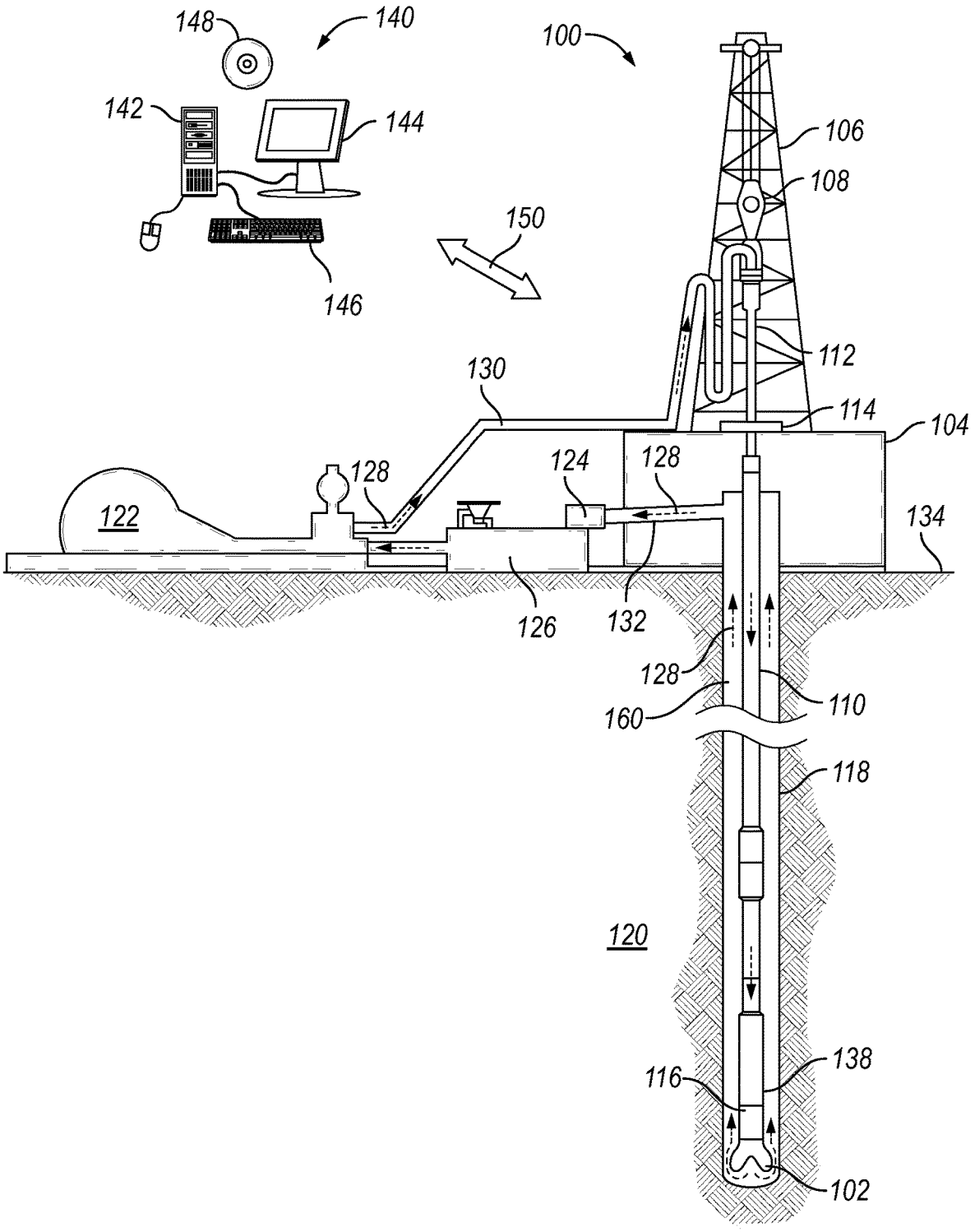
FIG. 1 illustrates an example of a drilling system.

FIG. 1 illustrates a drilling system 100 that may include a drill bit 102 undergoing drilling operations. It should be noted that while FIG. 1 generally depicts drilling system 100 in the form of a land-based system, those skilled in the art will readily recognize that the principles described herein are equally applicable to subsea drilling operations that employ floating or sea-based platforms and rigs, without departing from the scope of the disclosure.

Drilling system 100 may include a drilling platform 104 that supports a derrick 106 having a traveling block 108 for raising and lowering a drill string 110. A kelly 112 may support drill string 110 as drill string 110 may be lowered through a rotary table 114. Drill string 110 may include a drill bit 102 attached to the distal end of drill string 110 and may be driven either by a downhole mud motor 116, discussed below, and/or via rotation of drill string 110. Without limitation, drill string 110 may include any suitable type of drill bit 102, including, but not limited to, roller cone bits, fixed cutter bits, PDC bits, natural diamond bits, any hole openers, reamers, coring bits, and the like. As drill bit 102 rotates, drill bit 102 may create a borehole 118 that penetrates various formations 120.

The rotation of drill bit 102 may be controlled by mud motor 116. In examples, mud motor 116 may allow for directionally steering within borehole 118 and may deliver additional energy to drill bit 102 to improve drilling performance. Mud motor 116 may deliver additional power to drill bit 102 by converting fluid energy from the drilling fluid 128, to mechanical rotation of a drill bit shaft in at least a portion of mud motor 116. The conversion of fluid energy to mechanical rotation may be performed by an elastomeric stator within which a metallic rotor rotates as fluid is pumped through it. The speed with which the mud motor 116 rotates drill bit 102 is a function of the mud flow rate and the design or configuration of a particular stator and rotor within a mud motor power section. Likewise, the torque applied to drill bit 102 is a function of the differential pressure across the mud motor power section and the design of mud motor 116.

Drilling system 100 may further include a mud pump 122, one or more solids control systems 124, and a retention pit 126. Mud pump 122 representatively may include any conduits, pipelines, trucks, tubulars, and/or pipes used to fluidically convey drilling fluid 128 downhole, any pumps, compressors, or motors (e.g., topside or downhole) used to drive the drilling fluid 128 into motion, any valves or related joints used to regulate the pressure or flow rate of drilling fluid 128, any sensors (e.g., pressure, temperature, flow rate, etc.), gauges, and/or combinations thereof, and the like.

Mud pump 122 may circulate drilling fluid 128 through a feed conduit 130 and to kelly 112, which may convey drilling fluid 128 downhole through the interior of drill string 110 and through one or more orifices (not shown) in drill bit 102. Drilling fluid 128 may then be circulated back to surface 134 via a borehole annulus 160 defined between drill string 110 and the walls of borehole 118. At surface 134, the recirculated or spent drilling fluid 128 may exit borehole annulus 160 and may be conveyed to one or more solids control system 124 via an interconnecting flow line 132. One or more solids control systems 124 may include, but are not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, and/or any fluid reclamation equipment. The one or more solids control systems 124 may further include one or more sensors, gauges, pumps, compressors, and the like used to store, monitor, regulate, and/or recondition the drilling fluid 128.

After passing through the one or more solids control systems 124, drilling fluid 128 may be deposited into a retention pit 126 (e.g., a mud pit). While illustrated as being arranged at the outlet of borehole 118 via borehole annulus 160, the one or more solids controls system 124 may be arranged at any other location in drilling system 100 to facilitate its proper function, without departing from the scope of the disclosure. While FIG. 1 shows only a single retention pit 126, there could be more than one retention pit 126, such as multiple retention pits 126 in series. Moreover, retention pit 126 may be representative of one or more fluid storage facilities and/or units where the drilling fluid additives may be stored, reconditioned, and/or regulated until added to drilling fluid 128.

Drilling system 100 may further include information handling system 140 configured for processing the measurements from sensors (where present), such as sensor package 224, discussed below, disposed on drill bit 102. Measurements taken may be transmitted to information handling system 140 by communication module 138. As illustrated, information handling system 140 may be disposed at surface 134. In examples, information handling system 140 may be disposed downhole. Any suitable technique may be used for transmitting signals from communication module 138 to information handling system 140. A communication link 150 (which may be wired, wireless, or combinations thereof, for example) may be provided that may transmit data from communication module 138 to information handling system 140. Without limitation, information handling system 140 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 140 may be a personal computer, a network storage device, or any other suitable device and may vary in size, shape, performance, functionality, and price. Information handling system 140 may include random access memory (RAM), one or more processing resources (e.g., a microprocessor) such as a central processing unit 142 (CPU) or hardware or software control logic, ROM, and/or other types of nonvolatile memory. Additional components of information handling system 140 may include one or more monitors 144, an input device 146 (e.g., keyboard, mouse, etc.) as well as computer media 148 (e.g., optical disks, magnetic disks) that may store code representative of the methods described herein. Information handling system 140 may also include one or more buses (not shown) operable to transmit communications between the various hardware components.

In examples, information handling system 140 may be utilized to improve mud motor 116 construction while mud motor 116 may be utilized during drilling operations. For example, currently mud motor manufacturers commonly publish reference charts which plot the nominal speed and torque output of mud motor 116 with different combinations of flow rate and differential pressure. In practice, these nominal values vary due to mud properties, temperature, dimensional fit (e.g., clearance or interference) between the rotor and stator and the physical condition of mud motor 116. Before utilizing mud motor 116 during drilling operations, mud motor 116 may be placed in a surface dynamometer where a working fluid, usually water, is pumped through the motor and the output (e.g., torque and shaft speed) of the motor is measured and compared against the nominal power curve provided by the manufacturer. Such tests are also performed as a proof test to screen out mud motors 116 which may have infantile failures in the wellbore due to an assembly defect. However, in practice, surface dynamometers are rarely used. Currently, dynamometers may not be used due to the additional time and expense required to perform the test, availability of dynamometers, inability to replicate downhole conditions (i.e., downhole pressure and temperature), and inability to replicate drilling fluid properties.

Figure 2:
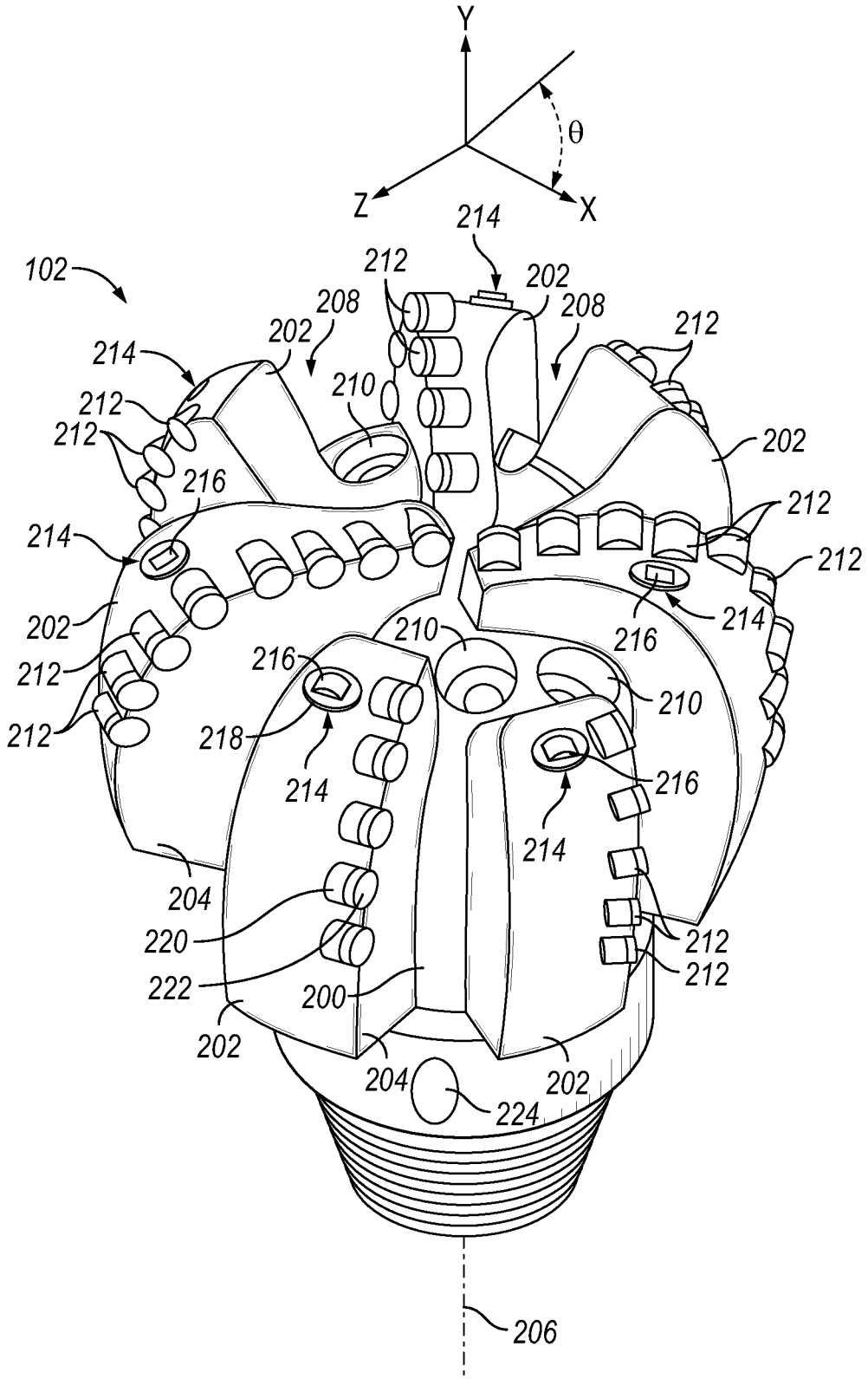
FIG. 2 illustrates an example of a drill bit.

FIG. 2 illustrates an example of drill bit 102 known as a fixed cutter bit. Without limitation, drill bit 102 may be applied to any fixed cutter drill bit category, including polycrystalline diamond compact (PDC) drill bits, sometimes referred to as drag bits, and which can be, for example, matrix drill bits and/or steel body drill bits depending on the composition and manufacture of the bit body. While drill bit 102 is depicted as a fixed cutter drill bit, the principles of the present disclosure are equally applicable to other types of drill bits operable to form a wellbore including, but not limited to, fixed cutter core bits, impregnated diamond bits and roller cone drill bits.

With continued reference to FIG. 2, drill bit 102 includes a bit body 200 of drill bit 102 which may include radially and longitudinally extending blades 202 having leading faces 204. Bit body 200 may be made of steel or a matrix of a harder material, such as tungsten carbide Bit body 200 rotates about a longitudinal drill bit axis 206 to drill into underlying subterranean formation under an applied weight-on-bit. Corresponding junk slots 208 are defined between circumferentially adjacent blades 202, and a plurality of nozzles or ports 210 may be arranged within junk slots 208 for ejecting drilling fluid that cools drill bit 102 and otherwise flushes away cuttings and debris generated while drilling.

Bit body 200 further includes a plurality of fixed cutters 212 secured within a corresponding plurality of cutter pockets sized and shaped to receive fixed cutters 212. Each fixed cutter 212 in this example comprises a fixed cutter secured within its corresponding cutter pocket via brazing, threading, shrink-fitting, press-fitting, snap rings, or any combination thereof. Fixed cutters 212 are held in blades 202 and respective cutter pockets at predetermined angular orientations and radial locations to present fixed cutters 212 at an angle against the formation being penetrated. As drill bit 102 is rotated, fixed cutters 212 are driven through the formation by the combined forces of the weight-on-bit and the torque experienced at drill bit 102 During drilling, fixed cutters 212 may experience a variety of forces, such as drag forces, axial forces, reactive moment forces, or the like, due to the interaction with the underlying formation being drilled as drill bit 102 rotates.

Each fixed cutter 212 may include a generally cylindrical substrate 220 made of an extremely hard material, such as tungsten carbide, and a cutting face 222 secured to the substrate 220. The cutting face 222 may include one or more layers of an ultra-hard material, such as polycrystalline diamond, polycrystalline cubic boron nitride, impregnated diamond, etc., which generally forms a cutting edge and the working surface for each fixed cutter 212. The working surface is typically flat or planar but may also exhibit a curved exposed surface that meets the side surface at a cutting edge.

Generally, each fixed cutter 212 may be manufactured using tungsten carbide as the substrate 220. While a cylindrical tungsten carbide "blank" may be used as the substrate 220, which is sufficiently long to act as a mounting stud for the cutting face 222, the substrate 220 may equally comprise an intermediate layer bonded at another interface to another metallic mounting stud. To form the cutting face 222, the substrate 220 may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the tipper surface of the substrate 220. When using polycrystalline diamond as the ultra-hard material, fixed cutter 212 may be referred to as a polycrystalline diamond compact cutter or a "PDC cutter," and drill bits made using such PDC fixed cutters are generally known as PDC bits.

As illustrated, drill bit 102 may further include a plurality of rolling element assemblies 214, each including a rolling element 216 disposed in housing 218. Housing 218 may be received in a housing pocket sized and shaped to receive housing 218. Without limitation, rolling element 216 may include a generally cylindrical body strategically positioned in a predetermined position and orientation on bit body 200 so that rolling element 216 is able to engage the formation during drilling. It should be noted that rolling element 216 may also be a ball bearing, cylindrical, needle, tapered, and/or circular in shape. The orientation of a rotational axis of each rolling element 216 with respect to a direction of rotation of a corresponding blade 202 may dictate whether any identified rolling element 216 operates purely as a rolling DOCC element, purely a rolling cutting element, or a hybrid of both. The terms "rolling element" and "rolling DOCC element" are used herein to describe the rolling element 216 in any orientation, whether it acts purely as a DOCC element, purely as cutting element, or as a hybrid of both. Rolling elements 216 may prove advantageous in allowing for additional weight-on-bit (WOB) to enhance directional drilling applications without over engagement of fixed cutters 212, and to minimize the amount of torque required for drilling Effective DOCC also limits fluctuations in torque and minimizes stick-slip, which may cause damage to fixed cutters 212. An optimized three-dimensional position and three-dimensional orientation of rolling element 216 may be selected to extend the life of the rolling element assemblies 214, and thereby improve the efficiency of drill bit 102 over its operational life. As described herein, the three-dimensional position and orientation may be expressed in terms of a Cartesian coordinate system with the Y-axis positioned along longitudinal axis 206, and a polar coordinate system with a polar axis positioned along longitudinal axis 206. Without limitation, drill bit 102 may include a sensor package 224, further discussed below.

Figure 3:
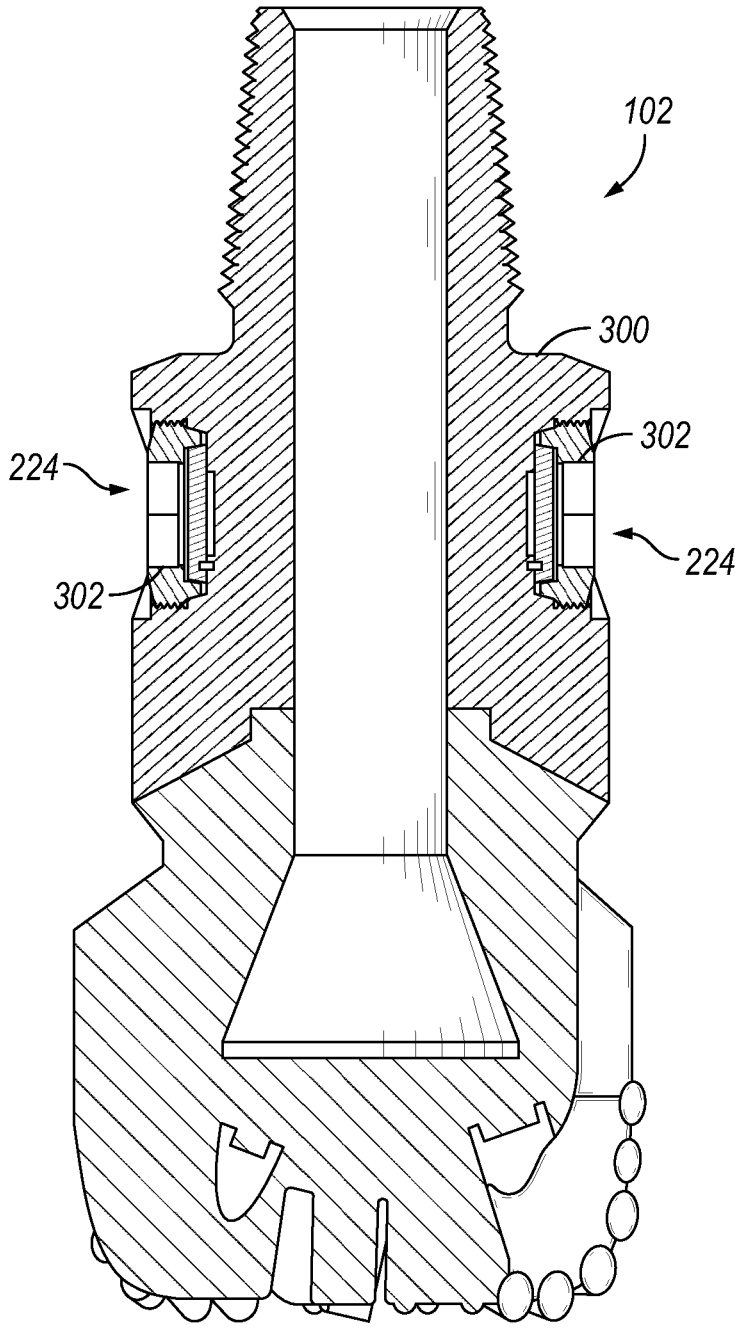
FIG. 3 illustrates a cross section view of the drill bit and location of a sensor package.

FIG. 3 illustrates a cross sectional view of a removable sensor package 224 disposed in a drill bit 102. In other examples, sensor package 224 may be non-removable. As illustrated in FIG. 3, there are two sensor package 224 is disposed in a shank 300 of drill bit 102. However, there may be any number of measurement devices that measure different vibration within sensor package 224 disposed in shank 300. As illustrated, sensor packages 224 may be an insert with a puck like design. Each sensor package 224 is disposed approximately 180 degrees from one another within recessed areas 302. Recessed area 302 may be disposed on the exterior of shank 300. In examples, sensor package 224 may be held in recessed areas 302 through threading, compression, and/or the like. In one example, one or more sensor packages 224 may be disposed within one or more junk slots and/or fluid flow paths of drill bit 102. For example, one or more sensor packages 224 may be positioned such that downhole forces applied to junk slots and/or fluid flow paths may be similarly applied to one or more sensor packages 224 and, in turn, to the sensor packages 224 disposed thereon.

Figure 4:
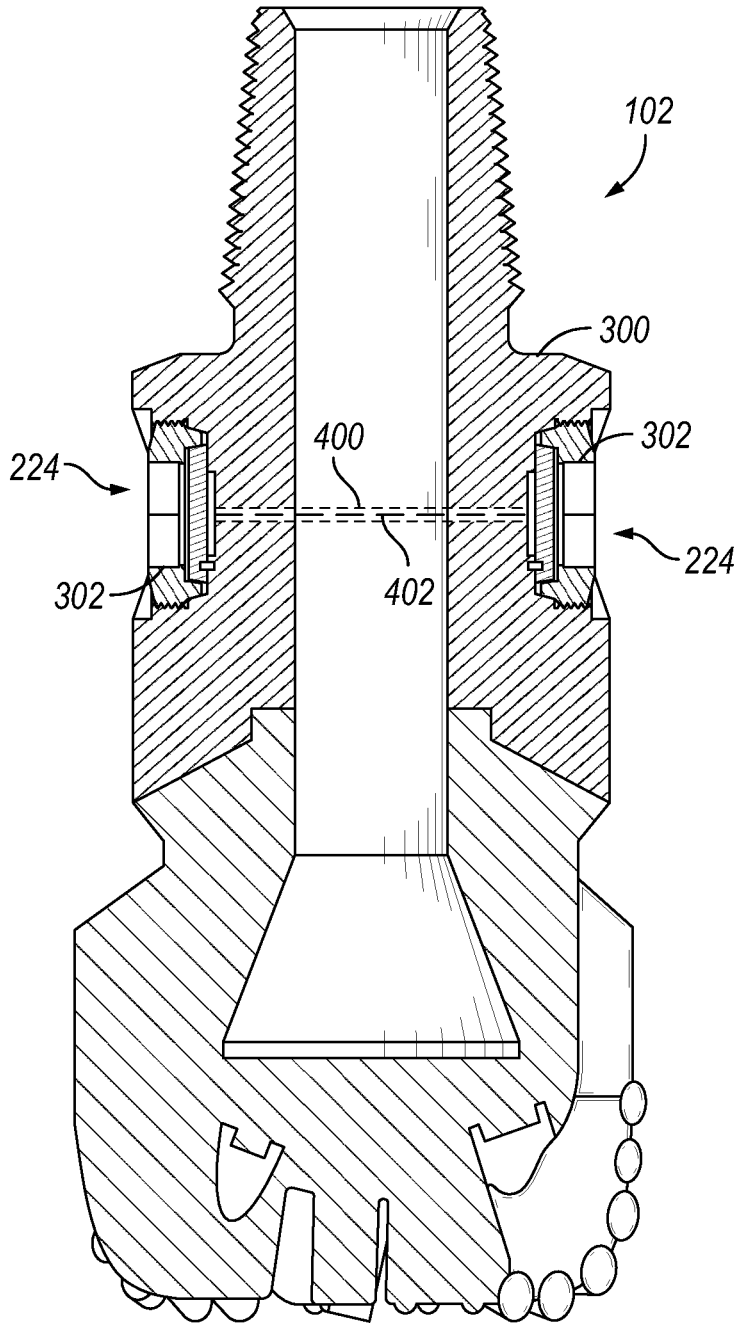
FIG. 4 illustrates two or more strain gauges connected together.

FIG. 4 illustrates an example wherein sensor packages are disposed in the shank 300 of the drill bit 102 approximately 180 degrees from one another and within the recessed area 302, may be interconnected. Shank 300 may include a bore 400 extending through shank 300 between sensor packages 224. Sensor packages 224 may be interconnected via a hardwire connection 402 extending between sensor packages 224 and through bore 400. Interconnecting sensor packages 224 may allow for improved packaging of sensor packages 224 with various downhole components (e.g., accelerometers, magnetometers, processors, batteries, etc.). Further, regarding positioning of sensor packages 224, interconnecting sensor packages 224 may allow sensor packages 224 to be spread further apart than non-interconnected strain gauges, which may improve measurement resolution. In another example, one or more sensor packages 224 may be disposed on one or more blades of drill bit 102 such that downhole forces applied to each of the one or more blades 202 (e.g., referring to FIG. 2) may be similarly applied to sensor packages 224 and to the strain gauges disposed thereon. In each of the examples described above, sensor packages 224 may include transmitters used to transmit data indicating downhole forces to one or more receivers such that the data from each sensor packages 224 may be analyzed.

Referring back to FIG. 3, each sensor package 224 may collect data indicating downhole forces applied to drill bit 102 during a drilling operation. In particular, downhole forces applied to shank 300 of drill bit 102 may be similarly applied to each sensor package 224. In examples, sensor package 224 may transmit data indicating downhole forces to one or more receivers such that the data from each sensor package 224 may be analyzed. Specifically, sensor package 224 may collect data indicating compression forces, bending forces, and torsional forces applied to each sensor package 224 during a drilling operation and may transmit the collected data in real-time. This data may be received by a receiver for real-time analysis or stored in a memory medium within drill bit 102 for analysis at a later time.

Analysis of data received from sensor package 224 by information handling system 140 (e.g., referring to FIG. 1) may suggest ways in which one or more downhole drilling parameters may be modified to reduce the magnitude of the downhole forces applied to drill bit 102. Examples of the downhole drilling parameters may include rotational speed of drill bit 102 in revolutions per minute (RPM), a rate of penetration (ROP), a weight on bit (WOB), a torque on bit (TOB), and a depth-of-cut (DOC). The rate of penetration (ROP) of drill bit 102 may be a function of both weight on bit (WOB) and revolutions per minute (RPM). Referring back to FIG. 1, drill string 110 may apply weight on drill bit 102 and may also rotate drill bit 102 about a rotational axis to form borehole 118. The depth-of-cut per revolution may also be based on ROP and RPM of a particular bit and indicates how deeply the cutting elements (e.g., referring to FIG. 2) may be engaging the formation. An analysis of the data received from sensor package 224 may indicate which of the downhole drilling parameters may be causing or contributing to compression forces, bending forces, and/or torsional forces applied to sensor package 224 during drilling operations.

Additionally, sensor packages 224 may be disposed approximately 180 degrees from one another, data received from strain gauges disposed on each sensor package 224 may be used simultaneously for analysis to determine downhole forces being applied to both sides of shank 300 (e.g., compression or bending). In examples, data indicating compression forces applied to both sensor package 224 may be analyzed to calculate the weight on bit (WOB) based on a compression value from either sensor package 224 or a compression value from the other sensor package 224.

In other examples, a bending value may be calculated based on a compression value from one sensor package 224 and a tension value (i.e., indicating a tensile force) from the other sensor package 224. In yet another examples, a torque on bit (TOB) value may be calculated based on torsion value (i.e., indicating a torsional force) applied to both sensor packages 224. In another example, drill bit 102 may include three sensor package 224 disposed 120 degrees from one another. In yet another example, drill bit 102 may include four sensor packages 224 disposed 90 degrees from one another. In each of these examples, data received from sensor package 224 may be used simultaneously for analysis to determine downhole forces being applied to shank 300, for example, to identify a direction of a bending force and/or to determine whether a torsional force is symmetric around shank 300.

Values indicating WOB, bending, and TOB may be used to determine a set of optimized downhole drilling parameters in order to extend the lifetime of the downhole drilling tool and/or perform more efficient drilling operations. In particular, if WOB exceeds an adjustable threshold, compression forces applied to the downhole drilling tool may damage the downhole drilling tool or result in inefficient drilling operations. Accordingly, WOB may be modified such that WOB is within the adjustable threshold. Similarly, if a bending value exceeds an adjustable threshold, bending forces may damage the downhole drilling tool or drill string 110 (e.g., referring to FIG. 1) of drilling system 100 (e.g., referring to FIG. 1). In response, the bending value may be modified such that the bending value is within the adjustable threshold, thereby reducing the bending forces applied to the downhole drilling tool. Lastly, if TOB exceeds an adjustable threshold, the TOB may be modified such that the TOB value is within the adjustable threshold, thereby reducing torsional forces applied to the downhole drilling tool. Additionally, if WOB, bending, and TOB values are determined to be within only a fraction (e.g., 25 percent) of each corresponding adjustable threshold, downhole drilling parameters may be modified to increase compression forces (i.e., WOB), bending forces, and torsional forces (i.e., TOB) such that the modified downhole drilling parameters may result in more efficient drilling operations.

As discussed above, sensor package 224 may take downhole measurements of forces applied to drill bit 102. These parameters may be weight on bit, torque on bit, inner pressure, outer pressure, rotational speed, and/or the like. In examples, parameters that may be measured may be transmitted to the information handling system 140 to be processed with surface characteristics that are taken at drilling platform 104. Without limitation, surface data may be pipe rotation rate, flow rate, differential pressure, and/or the like. The information handling system 140 may receive the surface data from sensors disposed proximate the drilling platform 104 (e.g., referring to FIG. 1) or from another source. Utilizing parameters measured downhole and surface data, information handling system 140 may be utilized to determine unconfined compressive strength (UCS).

Identifying UCS may allow for bit wear to be determined in real time during drilling operations or after drilling operations.

Figure 5:
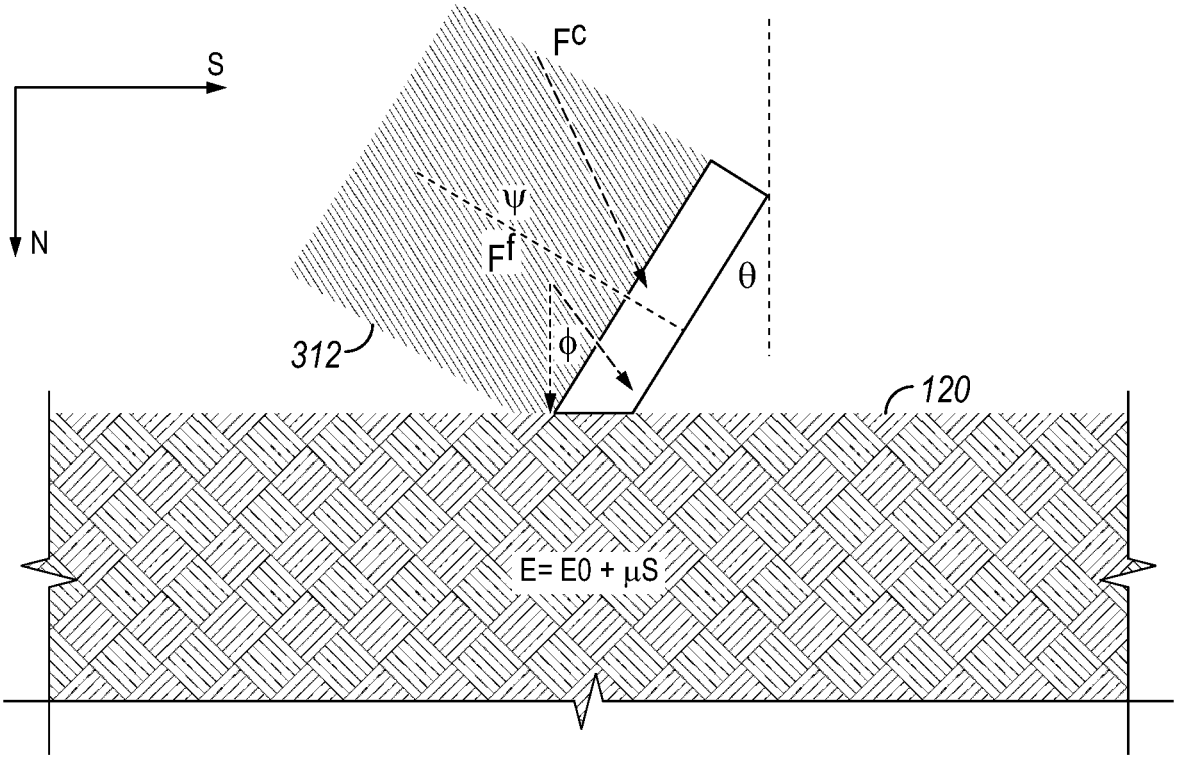
FIG. 5 illustrates angles of force utilized by a cutter on a formation.

Bit wear may be determined by identifying the action of a single fixed cutter 212 on formation 120. FIG. 5 is an illustration of fixed cutter 212 asserting a force on formation 120 through mathematical equations. Cutting forces exerted on formation 120 by fixed cutter 212 may be described as:

$$F_s^c = \varepsilon wd \tag{1}$$

$$F_n^c = \zeta \varepsilon wd, \text{ where } \zeta = \tan(\theta + \psi) \tag{2}$$

where ε is intrinsic specific energy, w is cutter wear width, and d is depth of cut. Additionally, ζ is a cutting force inclination coefficient. Friction for a dull cutter is described as:

$$F_s^f = \mu F_n^f \tag{3}$$

where p is a friction coefficient. Additionally governing Equations may also be used:

$$F_n = F_n^c + F_n^f \tag{4}$$

$$F_s = (1 - \mu\zeta)\varepsilon wd + \mu F_n \tag{5}$$

$$E = \frac{F_s}{wd} \tag{6}$$

$$S = \frac{F_n}{wd} \tag{7}$$

$$E = E_0 + \mu S \tag{8}$$

$$E_0 = (1 - \mu\zeta)\varepsilon \tag{9}$$

Equation (9) is applied to a single fixed cutter 212 for a single cutter test in which single fixed cutter 212 cuts into a rock, which may allow rock properties to be measured. For a PDC drill bit 102, specific energy (E) and drilling strength (S) are defined respectively:

$$E = \frac{2TOB}{a^2\delta} \tag{10}$$

$$S = \frac{WOB}{a\delta} \tag{11}$$

$$\delta = \frac{ROP}{5RPM} \tag{12}$$

For sharp drill bit 102:

$$E = \frac{1}{\zeta} S \tag{13}$$

For a worn drill bit 102:

$$E=E_0+\mu\gamma S \tag{14}$$

In equation (12), ROP is rate of penetration per hour (ft/hr), RPM is bit rotational speed (rpm) and $\delta$ has unit of inch/rev.

Figure 6:
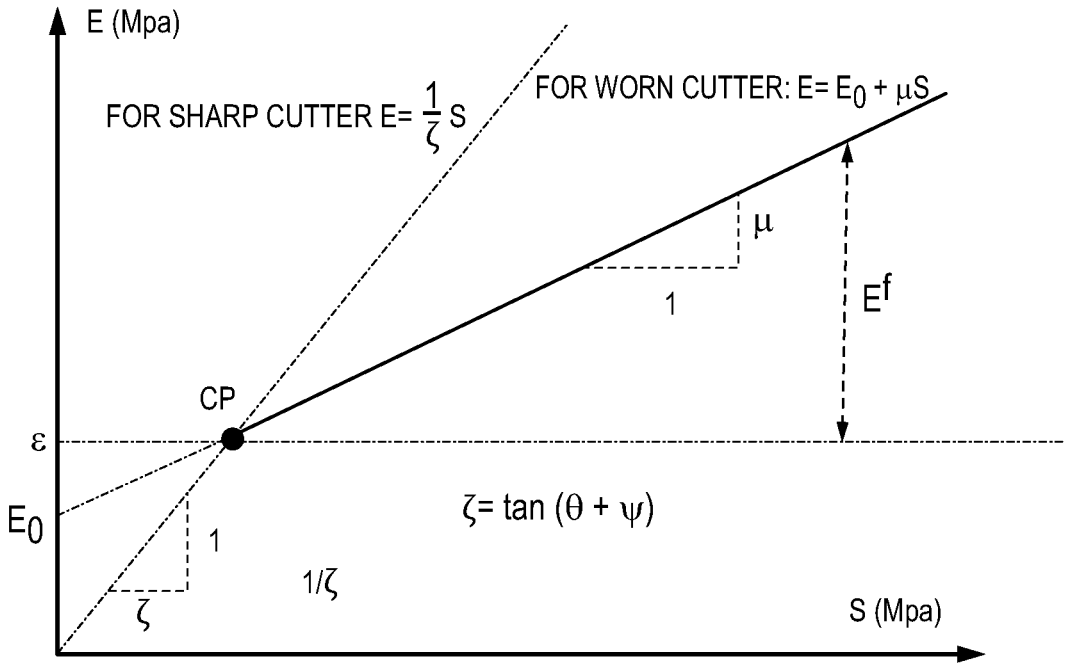
FIG. 6 illustrates a force diagram of the cutter on the formation.

FIG. 6 is a graph that may be utilized to solve for the variables that may be used for Equations (1)-(14) above. Using the graph in FIG. 6, variables $\mu$, $\psi$, $\zeta$, $\varepsilon$ may be found. Additionally, the variable $\varepsilon_0$ may be found using:

$$\varepsilon_0 = \frac{E_0}{1-\mu\zeta} \tag{15}$$

It is also noted that $\psi$ is the PDC/rock friction angle and may depend only on Polycrystalline diamond compact (PDC) material and type of rock that drill bit 102 may be encountering within formation 120 during drilling operations, and $\zeta$ may depend on $\psi$ and cutter back rake angle $\theta$, using Equation (2). Additionally, $\mu$ may be internal friction angle of rock, which may depend only on type of rock and $E^f$ is energy dissipated in friction.

As noted above, two additional parameters are determined. The cutting force inclination coefficient and the bit constant. Current technology makes assumptions regarding these two variables. However, these two variables are found utilizing mathematical formulations. For example, cutting force inclination coefficient $\zeta$ is found using Equation (2). As noted above, for a PDC cutter 212 (e.g., referring to FIG. 5), $\theta$ is the back rake angle. For a PDC drill bit 102 (e.g., referring to FIG. 1), $\theta$ is the average back rake angle of face PDC cutters 212. Additionally, $\psi$ is the friction angle between cutter face and rock surface, usually, $\psi$ may be approximately 15 to 25 degrees. Further, bit constant $\gamma$, is found by:

$$\gamma = \frac{2\sum_i b_i p_i^L}{a\sum_i b_i} \tag{16}$$

Figure 7:
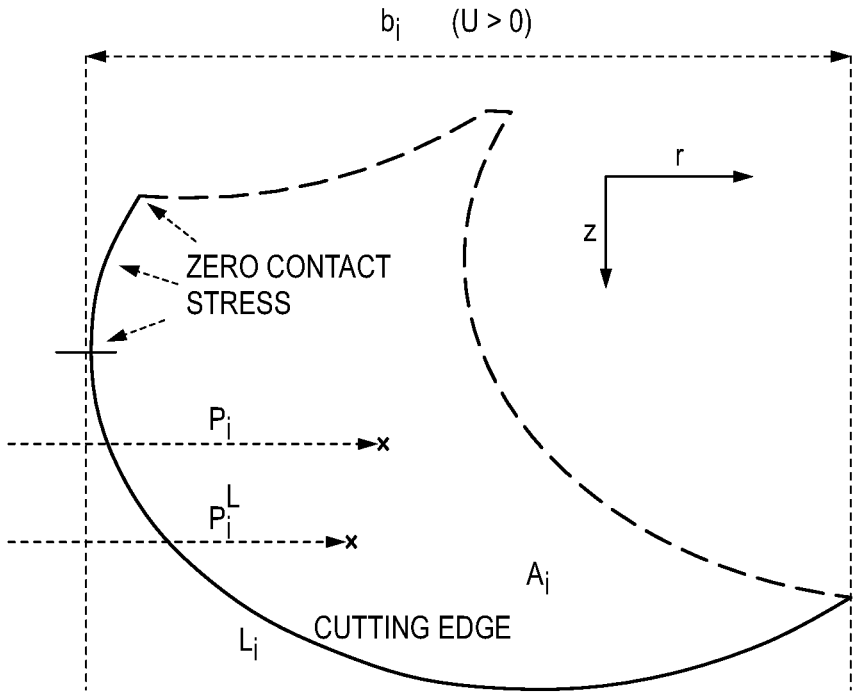
FIG. 7 illustrates a schematic of a cutter.

Using FIG. 7, variables for Equation (16) may be found. For example, $\alpha$ is bit radius, $b_i$ is the length of the cutting edge projected in radial axis, $p_i^L$ is the centroid radial-coordinate of the cutting edge; and $p_i$ is the centroid location of the engagement surface.

Figure 8:
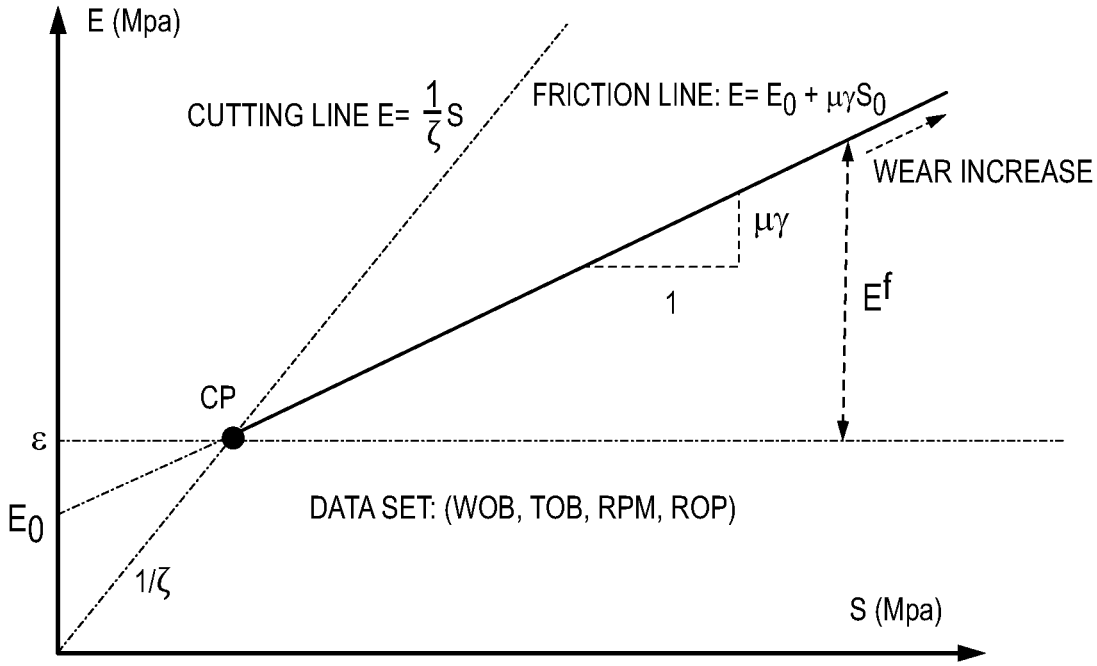
FIG. 8 illustrates the force diagram of FIG. 6 utilizing additional variables.

Using the graph in FIG. 8, confined compressive strength (CCS) is found by implementing:

$$\varepsilon = \frac{E_0}{1-\mu\gamma\zeta} = \frac{E_0}{1-\beta}, \text{ where } \beta < 1 \tag{17}$$

The increase of $\zeta$ may increase e. Additionally, the rock internal friction angle may be found using the graph in FIG. 8 and $$\psi = a\tan(\mu) \tag{18}$$

Additionally, fiction energy is identified by the variable $E^f$, for bit wear. With continued use of the graph in FIG. 8, contact force ($\lambda\sigma$) may be found using:

$$\lambda\sigma = \frac{\delta(E-\varepsilon)}{\mu\gamma} \tag{19}$$

Use of the graph in FIG. 8 may allow for relative contact length to be found using:

$$\lambda = \frac{\delta(E-\varepsilon)}{\mu\gamma\varepsilon} \tag{20}$$

Which provides a measure of the bit wear state. Drilling efficiency may also be found using;

$$\eta = \frac{X-\mu\gamma}{(1-\mu\gamma\omega)\chi} \tag{21}$$

where $$\chi = \frac{E}{S} \tag{22}$$

Figure 9:
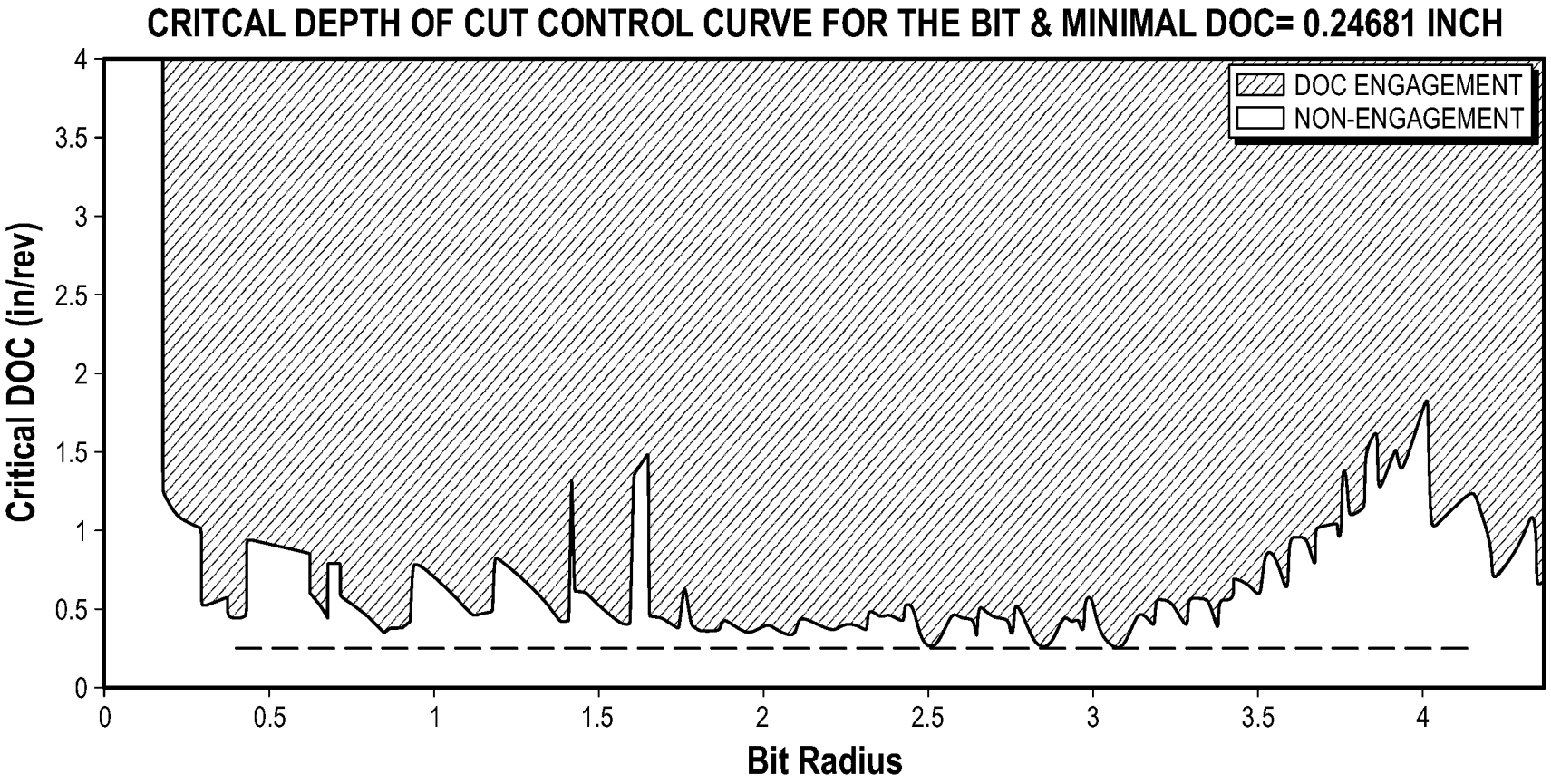
FIG. 9 is a graph showing depth of cut for a drill bit.

It should be noted, in Equations (16)-(22) and graphs in FIGS. 7 and 8 above, only cutter forces (cutting force and friction force from cutters) are considered. However, any bladed Polycrystalline Diamond Compact (PDC) bit (i.e., drill bit 102) has a blade surface which may contact formation when depth of cut is large enough. The forces due to blade surface contact may be contributed to the measured wight on bit (WOB) and torque on bit (TOB). In addition, most of PDC bits have non-cutting elements such as depth of cut controllers. These non-cutting elements may be in contact with formation. The forces due to the contact may also be contributed to the measured WOB and TOB. This is illustrated in FIG. 9, where the graph shows that when an instant depth of cut is over 0.24681 in/rev, the associated point in bit response is not utilized for the calculations discussed above.

Referring back to the graph in FIG. 8, if $E_i>E_{max}$ and $S_i>S_{max}$ the measurements may be disregarded. If $E_i<E_{min}$ and $S_i<S_{min}$, the measurements may be disregarded. If $E_0<0$, the measurements may be disregarded. If $\beta=\mu\lambda\zeta>1$ the measurements may be disregarded. If $\varphi=a\tan(\mu)<5$ deg, the measurements may be disregarded. If $E_i<\varepsilon$, disregard the point ($\varepsilon_0$).

Unconfined compressive strength (UCS) is related to intrinsic specific energy ($\varepsilon_0$). Additionally, intrinsic specific energy may be related to pore pressure using the following Equations:

$$\varepsilon = \varepsilon_0 + m(p_m - p_0) \tag{23}$$

$$m = \frac{2\sin(\varphi)\cos(\theta+\psi)}{1-\sin(\theta+\varphi+\psi)} = 3 \sim 25 \tag{24}$$

where $p_m$ is hole bottom pressure, $p_0$ is rock pore pressure, $\varepsilon_0$ is intrinsic specific energy and e is specific energy, which may be found using the Equations and methods above. Further $$P_m=(mud\ \text{weight}+0.3)\times 0.052\times TVD(psi) \tag{25}$$

Additionally, $\varphi=a\tan(\mu)$ and is rock internal friction angle, $\psi$ is friction angle at the cutting face/failed rock interface, and $\theta$ is a cutter back rake angle. Further, these variables may be related as:

$$\theta+\psi=a\tan(\zeta) \tag{26}$$

Under atmospheric conditions:

$$P_m=P_0=0 \quad (27)$$

$$\varepsilon=\varepsilon_0 \quad (28)$$

For highly permeable rock:

$$P_m=P_0 \quad (29)$$

$$\varepsilon=\varepsilon_0 \quad (30)$$

For highly impermeable rock:

$$p_0=0 \quad (31)$$

$$\varepsilon=\varepsilon_0+m(p_m-p_0) \quad (32)$$

For sedimentary rocks:

$$\varepsilon=\varepsilon_0+m(p_m-p_0) \quad (33)$$

FIG. 10 is a graph illustrating the correlation between $\varepsilon_0$ and UCS for a variety of rocks. From this graph a linear progression is seen between $\varepsilon_0$ and UCS depending on the rock interface.

Additionally, FIGS. 11A and 11B illustrate virgin pore pressure estimation. As illustrated, a Mohr circle 1100 represents cutting stress, bottom hole pressure, and pore pressure. This may be mathematical represented as:

$$\sigma_{min}=P_h-P_O \quad (34)$$

$$\sigma_{max}=S_c+P_h-P_0 \quad (35)$$

Additionally, virgin proper pressure estimation may be found by utilizing:

$$P_0=\frac{S_c}{2}\left(1-\frac{1}{\sin(\varphi)}\right)+\frac{S_0}{tg(\varphi)}+P_m \quad (36)$$

$$S_c=\frac{2TOB}{a^2\delta}(\text{specific energy}) \quad (37)$$

$$S_0=\frac{\varepsilon_0(1-\sin(\varphi)}{2\cos(\varphi)} \quad (38)$$

where $S_0$ is cohesion, $P_m$ is hole bottom pressure (See Equation (25)), and $\varphi$ is rock internal friction angle. Additionally, revolutions per minute (RPM), rate of penetration (ROP), and torque on bit (TOB) may be found using sensor package 224 (e.g., referring to FIG. 2), discussed above.

Figure 12A:
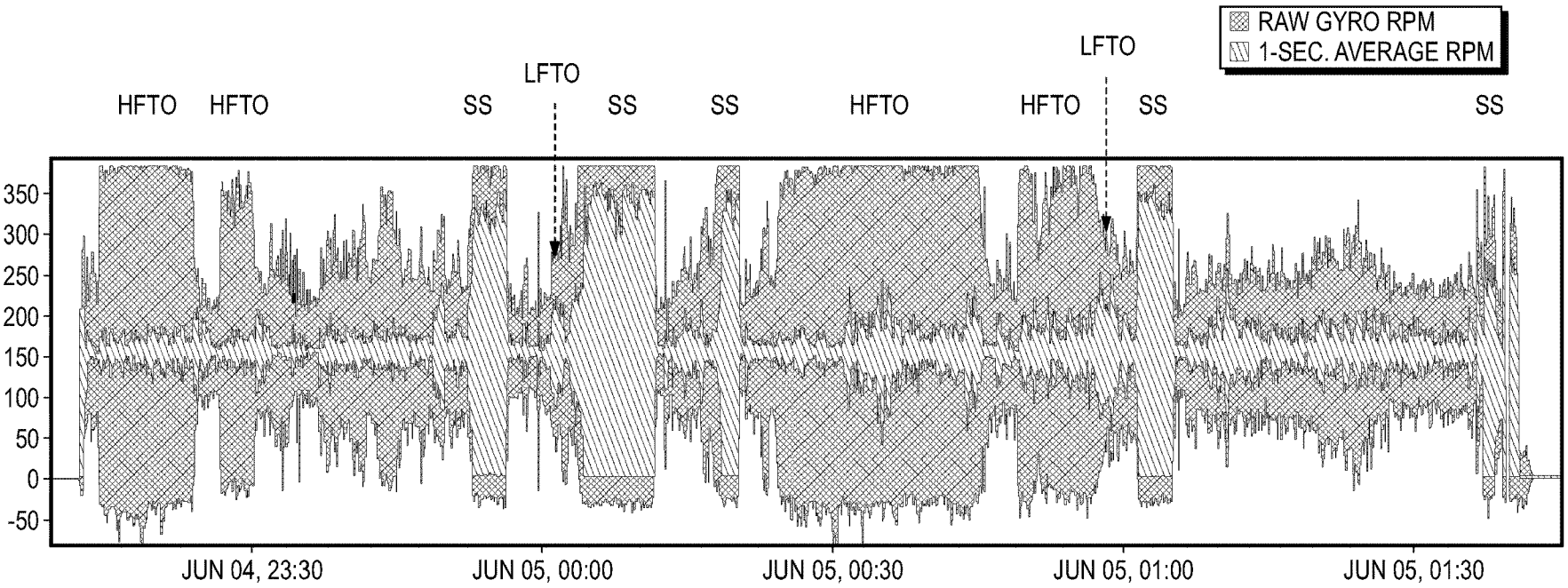
FIGS. 12A-12C are graphs showing different types of torsional vibrations.
Figure 12B:
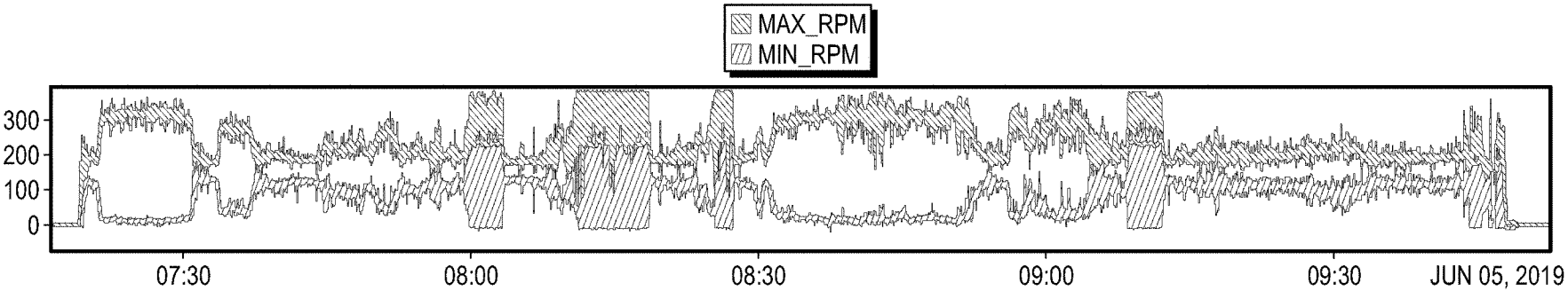
Figure 12C:
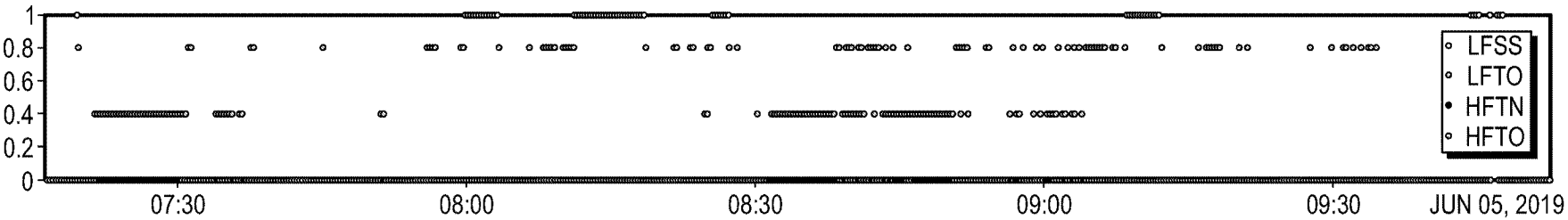

Sensor package 224 (e.g., referring to FIG. 2) may be utilized to identify four types of torsional vibrations. The four types of torsional vibrations are stick-slip vibration (SS), low frequency torsional oscillation (LFTO), high frequency torsional oscillation (HFTO), and high frequency torsional noise (HFTN). Each lithology layer is associated with a type of torsional vibration. As illustrated in FIGS. 12A-12C, identifying SS, LFTO, HFTO, HFTN, and where no dysfunction is measured identifies different layers within formation 120 (e.g., referring to FIG. 1).

Figure 13:
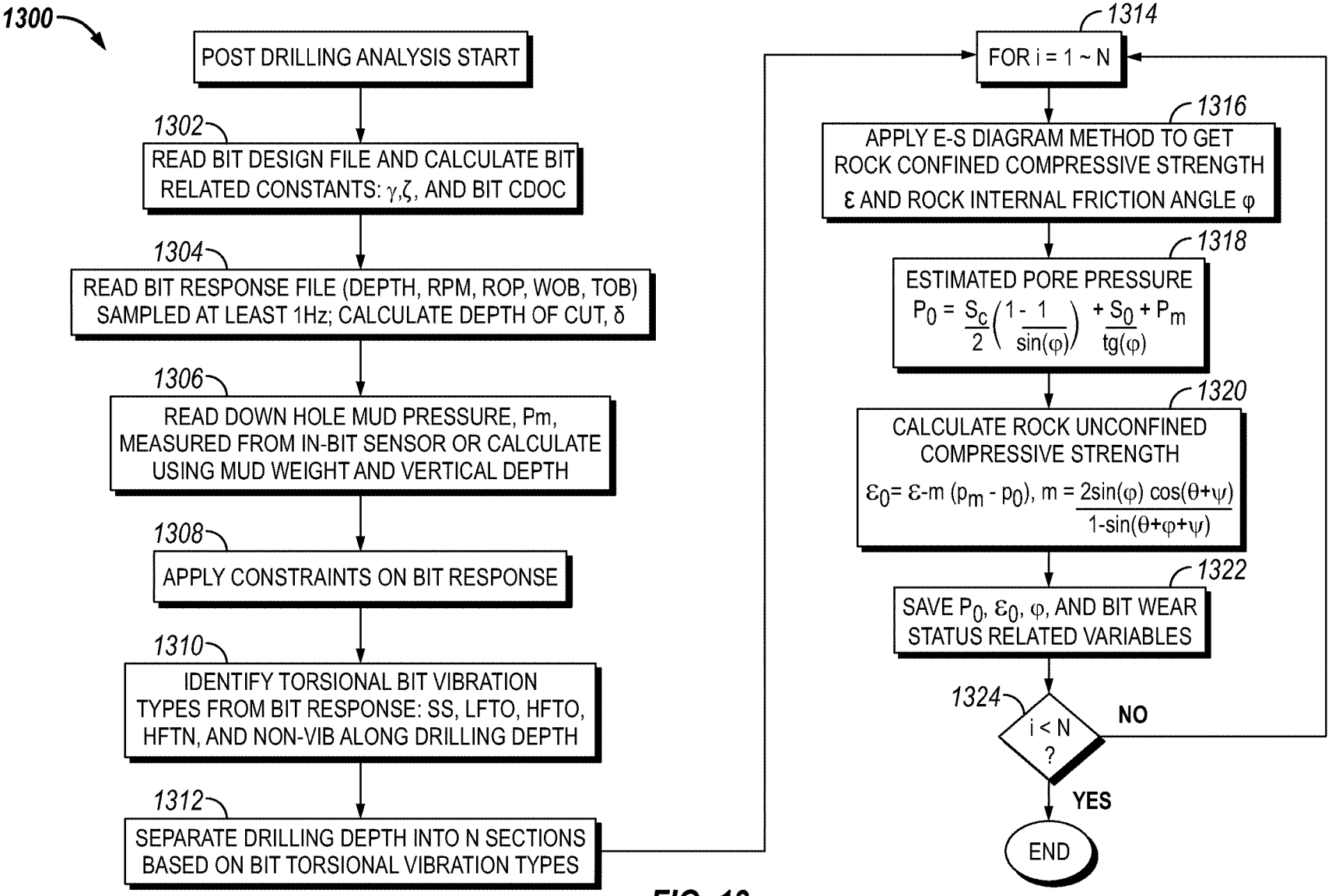
FIG. 13 is a workflow for post drill analysis of a drill bit performance during drilling operations.

FIG. 13 illustrates workflow 1300 for post drill analysis of drill bit 102 (e.g., referring to FIG. 1) performance during drilling operations. Workflow 1300 may begin with block 1302 in which constants for drill bit 102, such as $\zeta$, $\gamma$, and critical depth of cut (CDOC) are found utilizing the methods and Equations discussed above. After determining constants of drill bit 102, a depth of cut is calculated, represented as $\delta$, using measurements taken by sensor package 224 (e.g., referring to FIG. 2) on drill bit 102. In block 1304, measurements taken may comprise depth, revolutions per minute (RPM), rate of penetration (ROP), weight on bit (WOB), and torque on bit (TOB) all sampled at least at 1 Hz. Additionally, in block 1306, downhole mud pressure, $P_m$, measured by sensor package 224 on drill bit 102 are recovered or calculated using mud weight and vertical depth values. In block 1308, constraints on bit responses are applied. Constraints applied are minimal specific energy, a maximal specific energy, and minimal and maximal drilling strength, which are calculated using Equations (10) and (11).

Using the bit responses found in block 1310, torsional bit vibration types may be identified. The torsional bit vibration types identified may be stick-slip vibration (SS), low frequency torsional oscillation (LFTO), high frequency torsional oscillation (HFTO), high frequency torsional noise (HFTN), and/or non-vibration along drilling depth. In block 1312, drilling depths may be separated into N sections based on the bit torsional vibration types identified in block 1310. The N section are one or more bedding layers withing formation 120 (e.g., referring to FIG. 1). For example, if the torsional bit vibration types change along a depth interval, the change may be indicative of a change between bedding layers or type of material within the depth interval. Thus, in block 1314, the number of bedding layers are determined as:

$$i=1\hat{}N \quad (39)$$

In block 1316 for each bedding layer, rock confined compressive strength, represented as $\varepsilon$, and rock internal friction angle, represented as $\varphi$, are found using the methods and Equations discussed above. After identifying these variables, in block 1316, estimated pore pressure for each bedding layer is found in block 1318 using Equation (36). The variables solved in blocks 1316 and 1318 may be used in block 1320 to determine rock unconfined compressive strength (UCS) using Equations (23) and (24). After identifying UCS in block 1320, the variables $P_0$, $\varepsilon_0$, and $\varphi$ are stored along with other bit wear status related variables in block 1322. In block 1324, it is determined if i<N. If i is not less than N, then blocks 1314-1324 are repeated until i equals to N, which concludes workflow 1300.

Figure 14:
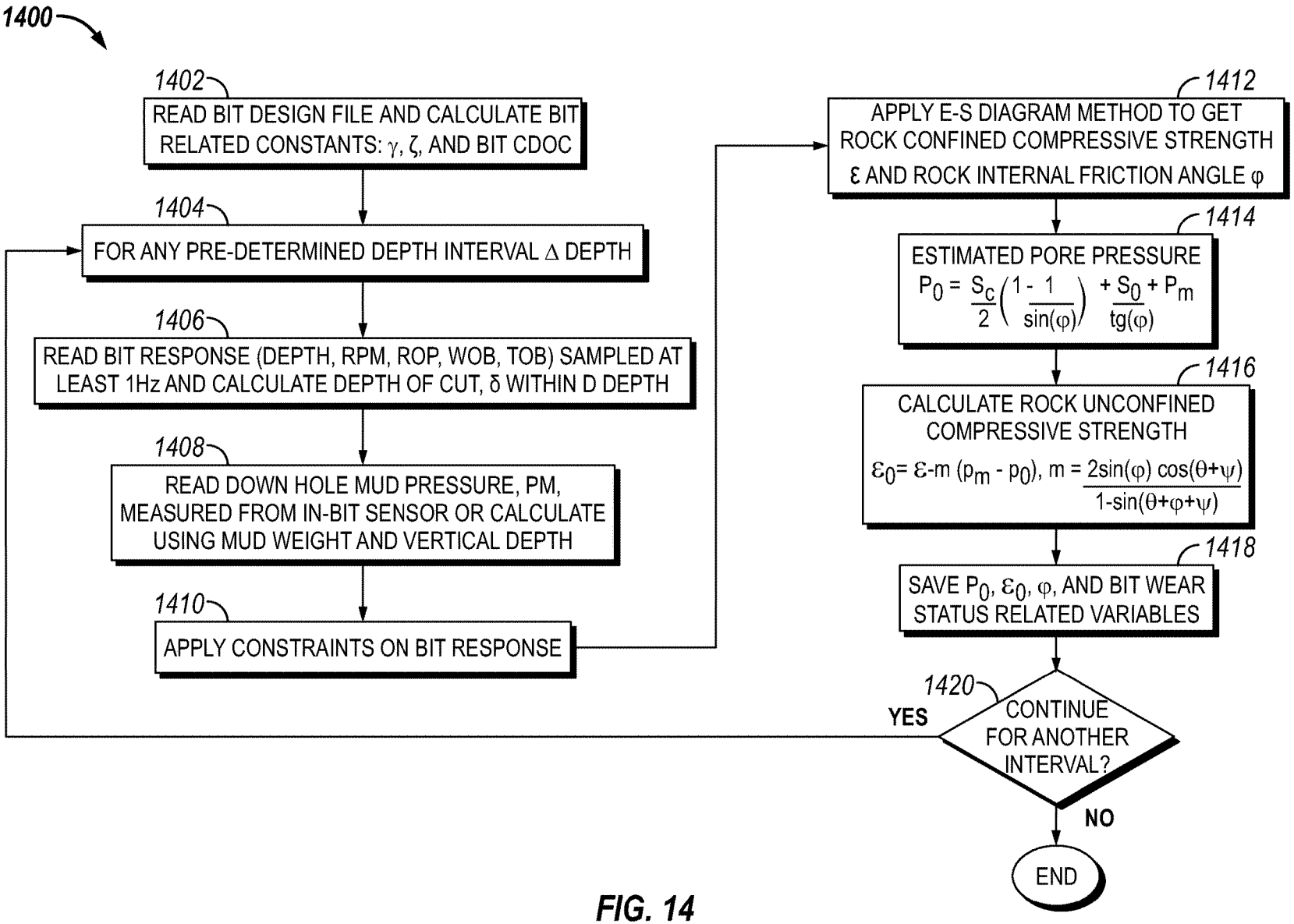
FIG. 14 is a workflow for identifying bit wear during drilling operations in real time.

FIG. 14 illustrates workflow 1400 for identifying bit wear of drill bit 102 (e.g., referring to FIG. 1) and/or unconfined compressive strength (UCS) at a depth within formation 120 during drilling operations in real time. In real time is defined as every second or every few seconds.

Workflow 1400 may begin with block 1402 in which constants for drill bit 102 (e.g., referring to FIG. 1), such as $\zeta$, $\gamma$, and critical depth of cut (CDOC) are found utilizing the methods and Equations discussed above. In block 1402, a pre-determined depth interval is chosen by an operator. The depth interval is a space between two selected depths within borehole 118 which is formed in formation 120. After determining constants of drill bit 102 in block 1402 and a pre-determined depth interval in block 1404, a depth of cut is calculated, represented as $\delta$, using measurements taken by sensor packages 224 (e.g., referring to FIG. 2) on drill bit 102.

Measurements taken may comprise depth, revolutions per minute (RPM), rate of penetration (ROP), weight on bit (WOB), and torque on bit (TOB) all sampled at least at 1 Hz. Additionally, in block 1408, downhole mud pressure, $P_m$, measured by sensor packages 224 on drill bit 102 are recovered or calculated using mud weight and vertical depth values. In block 1410, constraints on bit responses are applied.

Figure 15:
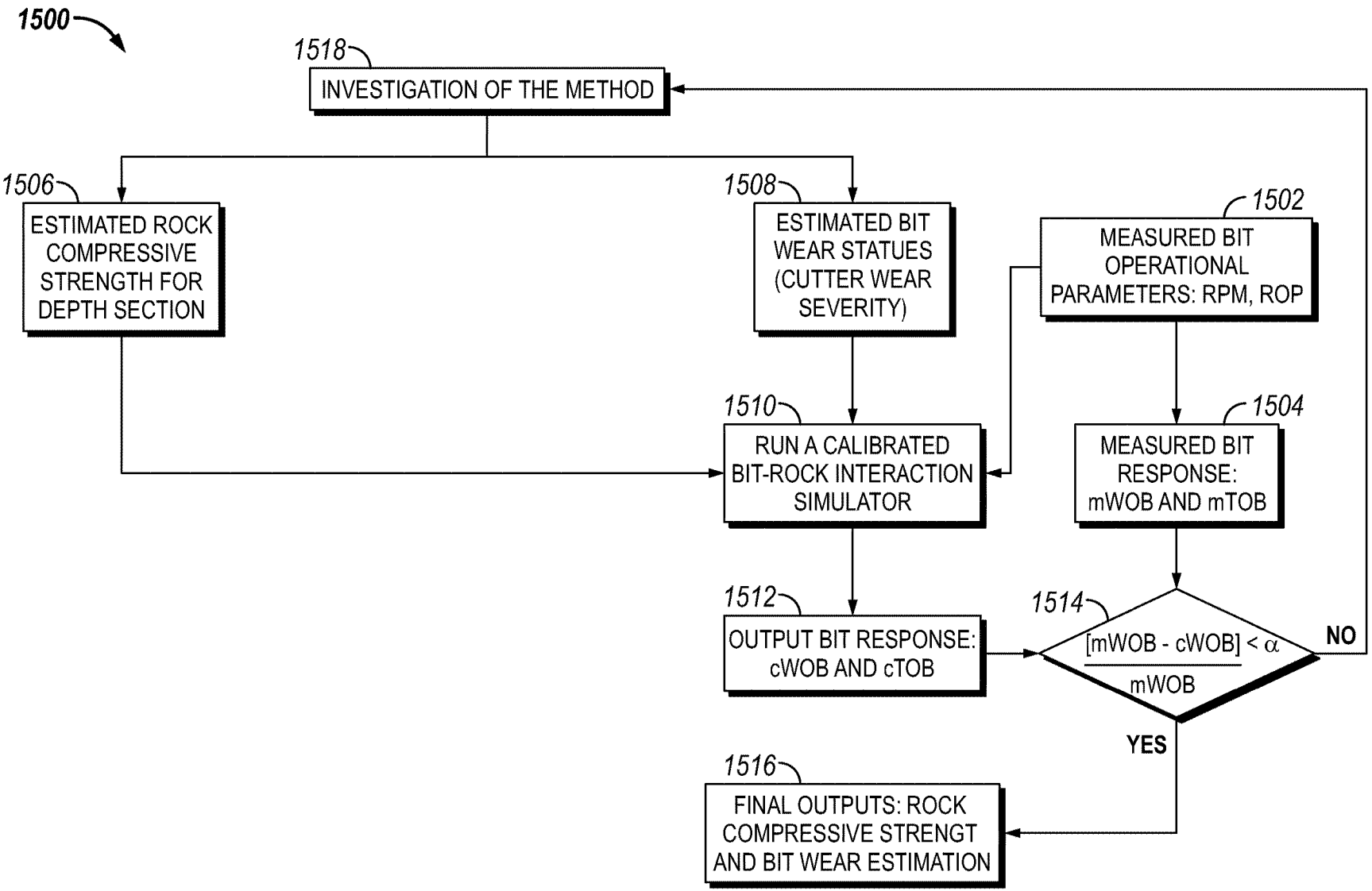
FIG. 15 is a workflow for verifying rock confined compressive strength (CCS) and bit wear of the drill bit.

In block 1412 rock confined compressive strength, represented as $\varepsilon$, and rock internal friction angle, represented as $\varphi$, are found using the methods and Equations discussed above. After identifying these variables, in block 1412, estimated pore pressure is found in block 1414 using Equation (36). The variables solved in blocks 1412 and 1414 may be used in block 1416 to determine rock unconfined compressive strength (UCS) using Equations (23) and (24). After identifying UCS in block 1416, the variables $P_0$, $\varepsilon_0$, and $\varphi$ are stored along with other bit wear status related variables in block 1418. For example, if the variables change along a depth interval, the change may be indicative of a change between bedding layers or type of material within the depth interval. In block 1420, an operator determines if workflow 1400 may continue for another interval. If another interval is desired by personnel, blocks 1406-1420 are performed again. However, if drilling operations have completed, another interval may not be sought. FIG. 15 illustrates workflow 1500 for verifying rock confined compressive strength (UCS) and bit wear of drill bit 102 (e.g., referring to FIG. 1) from workflow 1300 or workflow 1400. For example, workflow 1500 may begin with block 1502 in which bit operational parameters are measured during a drilling operation, bit operational parameters may be revolutions-per-minute (RPM) and Rate of Penetration (ROP). In block 1504, during drilling operations, drill bit responses are measured. Drill bit responses may comprise weight on bit (WOB) and/or torque on bit (TOB).

In block 1506, estimated rock CCS for a depth section is found using workflows 1300 or 1400. In block 1508, estimated bit wear is found using workflow 1300 or 1400. The CCS from block 1506 and the bit wear form block 1508 are utilized as inputs for a Bit-Rock Interaction Simulator in block 1510. Additionally, measured bit operational parameters form block 1502 are used as inputs in block 1510 for the Bit-Rock Interaction Simulator.

In block 1510, the Bit-Rock Interaction Simulator, takes RPM, ROP and CCS as its inputs. It calculates the engagement area and engagement shape of each cutter, then it calculates axial force, radial force and tangential force on each cutter. The WOB is the sum of all cutter axial forces. The TOB is the sum of cutter tangential force multiplied by its radial distance to bit axis. The outputs from block 1510 may be compared to the measured weight on bit (mWOB) in block 1504 and in block 1514 to verify measurements and accuracy of data.

In block 1514, measured WOB and cWOB are compared to each other as well as TOB and cTOB using the following Equations:

$$\frac{|mWOB - cWOB|}{mWOB} < \alpha \tag{40}$$

$$\frac{|mTOB - cTOB|}{mTOB} < \alpha \tag{41}$$

where $\alpha$ is a pre-defined acceptable ratio such as 25% or less. In other examples, a pre-defined acceptable ratio may be 5%, 10%, 15%, 20%, and/or the like. The ratio is chosen by personnel. If the results are less than a, then the rock UCS and bit wear estimation are confirmed in bloc 1516. If the results are more than a, then an investigation of the method in block 1518 is performed. For example, if the variables change along a depth interval, the change may be indicative of a change between bedding layers or type of material within the depth interval. This investigation determines if the input bit constants $\gamma$ and/or $\zeta$ the cutter wear severity, the number of rock layers are correct or need to be changed to reflect actual conditions downhole.

Improvements over current technology are found in estimating rock unconfined compressive strength and rock internal friction angle along well depth and estimating bit wear statues to help drilling engineer to make a decision to pull out the bit. Specifically, improvements are found in that weight on bit, torque on bit, bit revolutions per minute and surface rate of penetration are measured using a sensor package disposed in a drill bit. The well depth is divided into sub-sections using torsional vibration signals to ensure each subsection is associated with only one type of rock. Then calculate bit-related variables from each bit design which are $\gamma$ and $\zeta$, which currently are assumed for all values of a drill bit. Various constraints are developed and applied to the data sets to ensure the estimation makes sense. The estimated CCS is further validated by our in-house bit-rock interaction model. Overall, improvements are found in real time estimation of rock USC and internal friction angle along drilling depth, real time estimation of PDC bit wear statues along drilling depth. If friction energy is exponentially increased with drilling depth, it indicates bit wear is significant and it is time to pull out the bit, and drilling optimization for estimate drill ahead ROP. The systems and methods for identifying bit wear and formation layers may include any of the various features of the systems and methods disclosed herein, including one or more of the following statements.

Statement 1. A method may comprise identifying a depth interval during a drilling operation as a distance between a first depth and a second depth, measuring one or more drill bit responses within the depth interval using a sensor package disposed on the drill bit, and identifying one or more torsional bit vibrations within the depth interval from the one or more drill bit responses. The method may further comprise identifying one or more bedding layers of the formation within the depth interval from the one or more torsional bit vibrations, identifying a confined compressive strength (CCS) and an unconfined compressive strength (UCS) for each of the one or more bedding layers using the one or more drill bit responses and the one or more torsional bit vibrations, and identifying a bit wear of the drill bit within each of the one or more bedding layers using the one or more drill bit responses and the one or more torsional bit vibrations.

Statement 2. The method of statement 1, wherein the one or more drill bit responses are revolutions per minute (RPM), rate of penetration (ROP), weight on bit (WOB), or toque on bit (TOB).

Statement 3. The method of statements 1 or 2, wherein the one or more torsional bit vibrations are stick-slip vibration (SS), low frequency torsional oscillation (LFTO), high frequency torsional oscillation (HFTO), high frequency torsional noise (HFTN), or non-vibration along the depth interval.

Statement 4. The method of statements 1, 2, or 3, further comprising applying one or more constraints to the one or more drill bit responses.

Statement 5. The method of statement 4, wherein the one or more constraints are a minimal specific energy, a maximal specific energy, and a minimal and a maximal drilling strength.

Statement 6. The method of statements 1-4, further comprising calculating one or more drill bit constants.

Statement 7. The method of statement 6, wherein the one or more drill bit constants are a cutting force inclination coefficient, a bit constant $\gamma$, and a critical depth of cut.

Statement 8. The method of statements 1-5 or 6, further comprising, calculating a pore pressure.

Statement 9. The method of statement 8, further comprising using the pore pressure to identify the UCS.

Statement 10. The method of statements 1-5, 6, or 8, further comprising measuring a downhole mud pressure with the sensor package.

Statement 11. The method of statement 10, further comprising using the downhole mud pressure to identify the UCS.

Statement 12. The method of statements 1-5, 6, 8, or 10, wherein the drill bit further comprises a shank.

Statement 13. The method of statement 12, wherein the sensor package is an insert that is disposed in the shank of the drill bit.

Statement 14. The method of statement 12, wherein the sensor package is disposed in a recessed area of the shank in an exterior of the drill bit.

Statement 15. A system may comprise a drill bit. The drill bit may comprise a shank, a bit body connected to the shank, and one or more blades connected to the bit body. The system may further comprise a sensor package disposed on the drill bit. The sensor package measures one or more drill bit responses within a depth interval. The system may further comprise an information handling system in communication with the sensor package that identifies one or more torsional bit vibrations within the depth interval from the one or more drill bit responses, identifies one or more bedding layers of a formation within the depth interval from the one or more torsional bit vibrations, and identifies a confined compressive strength (CCS) and an unconfined compressive strength (UCS) for each of the one or more bedding layer using the one or more drill bit responses and the one or more torsional bit vibrations. The information handling system may further identify a bit wear of the drill bit within each of the one or more bedding layers using the one or more drill bit responses and the one or more torsional bit vibrations.

Statement 16. The system of statement 15, wherein the one or more drill bit responses are revolutions per minute (RPM), rate of penetration (ROP), weight on bit (WOB), or toque on bit (TOB).

Statement 17. The system of statements 15 or 16, wherein the one or more torsional bit vibrations are stick-slip vibration (SS), low frequency torsional oscillation (LFTO), high frequency torsional oscillation (HFTO), high frequency torsional noise (HFTN), or non-vibration along the depth interval.

Statement 18. The system of statements 15-17, wherein the information handling system further applies one or more constraints to the one or more drill bit responses, wherein the one or more constraints are a minimal specific energy, a maximal specific energy, and a drilling strength.

Statement 19. The system of statements 15-18, wherein the sensor package is an insert that is disposed in the shank of the drill bit or the sensor package is disposed in a recessed area of the shank in an exterior of the drill bit.

Statement 20. The system of statements 15-19, wherein the sensor package further measures a downhole mud pressure with the sensor package and the information handling system further uses the downhole mud pressure to identify the UCS.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

identifying a depth interval during a drilling operation as a distance between a first depth and a second depth;

measuring one or more drill bit responses within the depth interval using a sensor package disposed on a drill bit, wherein the drill bit comprises a shank, and wherein the sensor package is disposed in a recessed area of the shank in an exterior of the drill bit;

identifying one or more torsional bit vibrations within the depth interval from the one or more drill bit responses;

determining one or more bedding layers of the formation within the depth interval from the one or more torsional bit vibrations; and identifying a confined compressive strength (CCS) for each of the one or more bedding layers using the one or more drill bit responses and the one or more torsional bit vibrations.

2. The method of claim 1, wherein the one or more drill bit responses are revolutions per minute (RPM), rate of penetration (ROP), weight on bit (WOB), or toque on bit (TOB).

3. The method of claim 1, wherein the one or more torsional bit vibrations are stick-slip vibration (SS), low frequency torsional oscillation (LFTO), high frequency torsional oscillation (HFTO), high frequency torsional noise (HFTN), or non-vibration along the depth interval.

4. The method of claim 1, further comprising applying one or more constraints to the one or more drill bit responses.

5. The method of claim 4, wherein the one or more constraints are a minimal specific energy, a maximal specific energy, and a minimal and a maximal drilling strength.

6. The method of claim 1, further comprising calculating one or more drill bit constants.

7. The method of claim 6, wherein the one or more drill bit constants are a cutting force inclination coefficient, a bit constant 7, and a critical depth of cut.

8. The method of claim 1, further comprising, calculating a pore pressure.

9. The method of claim 8, further comprising identifying an unconfined compressive strength (UCS) for each of the one or more bedding layers using the one or more drill bit responses and the one or more torsional bit vibrations and using the pore pressure to identify the UCS.

10. The method of claim 1, further comprising measuring a downhole mud pressure with the sensor package.

11. The method of claim 10, further comprising identifying an unconfined compressive strength (UCS) for each of the one or more bedding layers using the one or more drill bit responses and the one or more torsional bit vibrations and using the downhole mud pressure to identify the UCS.

12. The method of claim 1, wherein the sensor package is an insert that is disposed in the shank of the drill bit.

13. The method of claim 1, further comprising identifying a bit wear of the drill bit within each of the one or more bedding layers using the one or more drill bit responses and the one or more torsional bit vibrations.

14. A system comprising:
- a drill bit comprising:
  - a shank;
  - a bit body connected to the shank; and
  - one or more blades connected to the bit body;
- a sensor package disposed on the drill bit, wherein the sensor package is disposed in a recessed area of the shank in an exterior of the drill bit, wherein the sensor package is configured to:
  - measure one or more drill bit responses within a depth interval; and
- an information handling system in communication with the sensor package, wherein the information handling system is configured to:
  - identify one or more torsional bit vibrations within the depth interval from the one or more drill bit responses;
  - determine one or more bedding layers of a formation within the depth interval from the one or more torsional bit vibrations; and
  - identify a confined compressive strength (CCS) for each of the one or more bedding layer using the one or more drill bit responses and the one or more torsional bit vibrations.

15. The system of claim 14, wherein the one or more drill bit responses are revolutions per minute (RPM), rate of penetration (ROP), weight on bit (WOB), or toque on bit (TOB).

16. The system of claim 14, wherein the one or more torsional bit vibrations are stick-slip vibration (SS), low frequency torsional oscillation (LFTO), high frequency torsional oscillation (HFTO), high frequency torsional noise (HFTN), or non-vibration along the depth interval.

17. The system of claim 14, wherein the information handling system further configured to apply one or more constraints to the one or more drill bit responses, wherein the one or more constraints are a minimal specific energy, a maximal specific energy, and a drilling strength.

18. The system of claim 14, wherein the sensor package is an insert that is disposed in the shank of the drill bit.

19. The system of claim 14, wherein the sensor package is further configured measure a downhole mud pressure with the sensor package and the information handling system is further configured identify an unconfined compressive strength (UCS) for each of the one or more bedding layer using the one or more drill bit responses and the one or more torsional bit vibrations and to use the downhole mud pressure to identify the UCS.

20. The system of claim 14, wherein the information handling system is further configured to identify a bit wear of the drill bit within each of the one or more bedding layers using the one or more drill bit responses and the one or more torsional bit vibrations.

21. A system comprising:
- a drill bit comprising:
  - a shank;
  - a bit body connected to the shank; and
  - one or more blades connected to the bit body;
- a sensor package, wherein the sensor package includes at least one insert that is secured, via threading and/or compression, within a recessed area formed in the drill bit, wherein the sensor package is configured to:
  - measure one or more drill bit responses within a depth interval; and
- an information handling system in communication with the sensor package, wherein the information handling system is configured to:
  - identify one or more torsional bit vibrations within the depth interval from the one or more drill bit responses;
  - determine one or more bedding layers of a formation within the depth interval from the one or more torsional bit vibrations; and
  - identify a confined compressive strength (CCS) for each of the one or more bedding layers using the one or more drill bit responses and the one or more torsional bit vibrations.

22. The system of claim 21, wherein the sensor package is configured to identify a bit wear of the drill bit within each of the one or more bedding layers using the one or more drill bit responses and the one or more torsional bit vibrations.

* * * * *